United States Patent [19]

Corbett

[11] Patent Number: 5,007,547

[45] Date of Patent: Apr. 16, 1991

[54] MULTI-PORT CONTAINER

[76] Inventor: Seguard Corbett, 2nd Floor, 839 - 5th Avenue S.W., Calgary, Alberta, Canada, T2P 3C8

[21] Appl. No.: 360,525

[22] Filed: Jun. 2, 1989

[51] Int. Cl.[5] ..... B65D 88/54

[52] U.S. Cl. ..... 220/476; 206/446; 220/908; 232/43.3

[58] Field of Search ..... 220/1 R, 1 T, 2, 18, 220/435, 437; 206/446; 232/1 A-1 E, 1 R, 43.1, 43.3, 43.5

[56] References Cited

U.S. PATENT DOCUMENTS

| | | | |
|---|---|---|---|
| 1,021,649 | 3/1912 | Wodarra | 220/18 |
| 1,316,023 | 9/1919 | Franklin | 232/1 A |
| 1,443,313 | 1/1923 | Denobili | 232/1 E |
| 1,515,922 | 11/1924 | Barnes | 232/43.3 |
| 2,769,516 | 11/1956 | Hensley, Jr. | 232/43.1 |

FOREIGN PATENT DOCUMENTS

| | | | |
|---|---|---|---|
| 2580604 | 10/1986 | France | 220/1 T |

*Primary Examiner*—Jimmy G. Foster

*Attorney, Agent, or Firm*—George Haining Dunsmuir

[57] ABSTRACT

The problem of carrying logs into a house and dumping them into a bin or the like is readily solved by a multi-port container for mounting in an exterior wall of a dwelling, the container having an opening in one side thereof outside the dwelling, a drum in the container with an opening aligned with the container opening for receiving the logs, the drum being rotatable to a second position in which the drum opening is aligned with a second opening in the container located inside the dwelling for unloading the logs. The structure can also be used as a garbage bin under a kitchen counter, or, by reversing the loading and unloading openings, in an exterior building wall for discharging garbage from the inside of the building.

9 Claims, 6 Drawing Sheets

MULTI-PORT CONTAINER

BACKGROUND OF THE INVENTION

This invention relates to a multi-port container.

More specifically, the invention relates to a container which can be used, for example for receiving logs outside of a dwelling and dispensing the logs through an opening in a dwelling, or for holding a garbage bag beneath a kitchen counter. A search of the patent literature fails to disclose a device of the type proposed by applicant. The only even remotely interesting prior art is Canadian Patent No 225,601, which issued to L. Marnus on Nov. 7, 1922. While the Marnus structure is simple, it does not perform the same function as applicant's apparatus.

The object of the present invention is to provide a relatively simple multi-port container which can be used domestically in a variety of locations and for a plurality of purposes.

BRIEF SUMMARY OF THE INVENTION

Accordingly, the present invention relates to a multi-port container comprising housing means; first and second openings in separate walls of said housing means permitting access to the interior thereof; drum means for receiving material in said container; a third opening in said drum means for loading said drum means or removing material therefrom; and roller means supporting said drum means for rotation in said housing means, whereby said drum means can be rotated to align said third opening with said first or second opening to permit loading and unloading of said drum means at different locations on said housing means.

BRIEF DESCRIPTION OF THE DRAWINGS

The invention will be described in greater detail with reference to the accompanying drawings, which illustrate preferred embodiments of the invention, and wherein.

DESCRIPTION OF THE PREFERRED EMBODIMENT(S)

Figure 2:
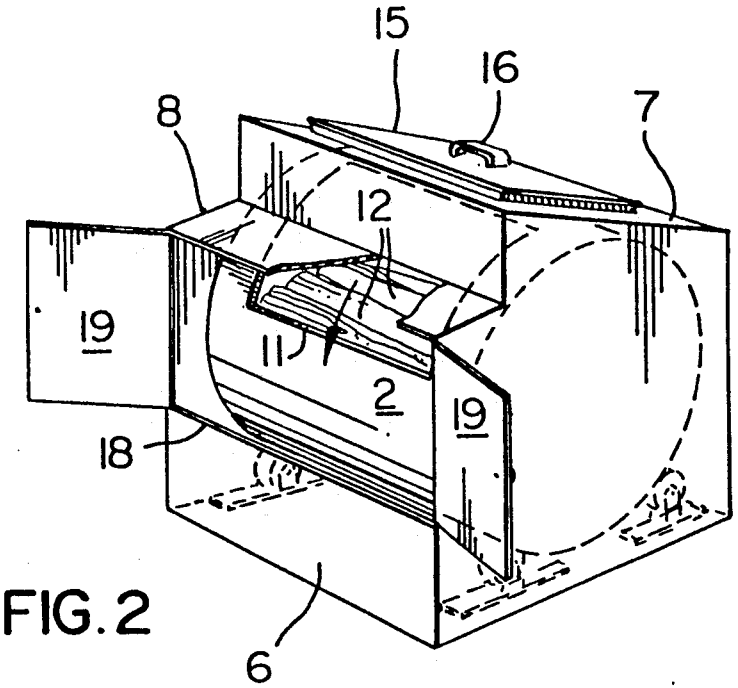
FIG. 2 is a partly sectioned, perspective view of the container of FIG. 1 from above and the other end thereof.
Figure 1:
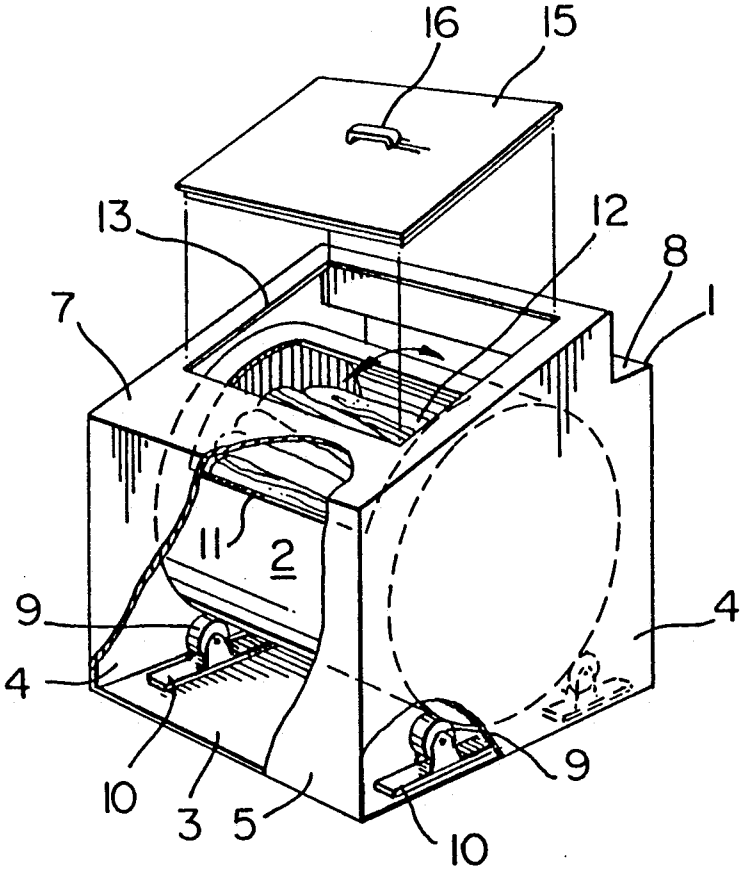
FIG. 1 is a partly sectioned, exploded perspective view from above and one end of a container in accordance with the present invention.

With reference to FIGS. 1 and 2, one embodiment of the container of the present invention includes a housing 1 containing a drum 2. The housing 1 is defined by a bottom wall 3, side walls 4, an inner or front wall 5, an outer or rear wall 6, an inclined top wall 7 and a shoulder 8 at the top of the outer wall 6. (The terms "inner", "front", "outer" and "rear" are chosen arbitrarily. In the present case the wall 5 would be inside of a dwelling and the wall 6 would be outside of the dwelling.) The drum 2 is rotatably mounted in the casing on rollers 9 which are mounted on brackets 10 connected to the bottom wall 3. An opening 11 is provided in one side of the drum 2 for receiving articles - in this case logs 12. The logs are removed from the drum 2 by aligning the opening 11 with an opening 13 in the inclined top wall 7 of the housing 1. The opening 13 is normally closed by a cover 15, which is equipped with a handle 16 for removing such cover.

The housing 1 is normally mounted in an exterior wall (not shown) of a dwelling, the wall engaging the shoulder 6 and one end of the bottom wall 3 of the housing 1. Thus, only one wall 6 of the housing is accessible from the exterior of the building. An opening 18 normally closed by doors 19 is provided in the wall 6, so that logs can be loaded into the drum 2 when the opening 11 is aligned with the opening 18. In order to remove the logs from the inside, i.e. when inside the dwelling, the cover 15 is lifted, and the drum 2 is rotated to align the openings 11 and 13 (FIG. 1).

Figure 3:
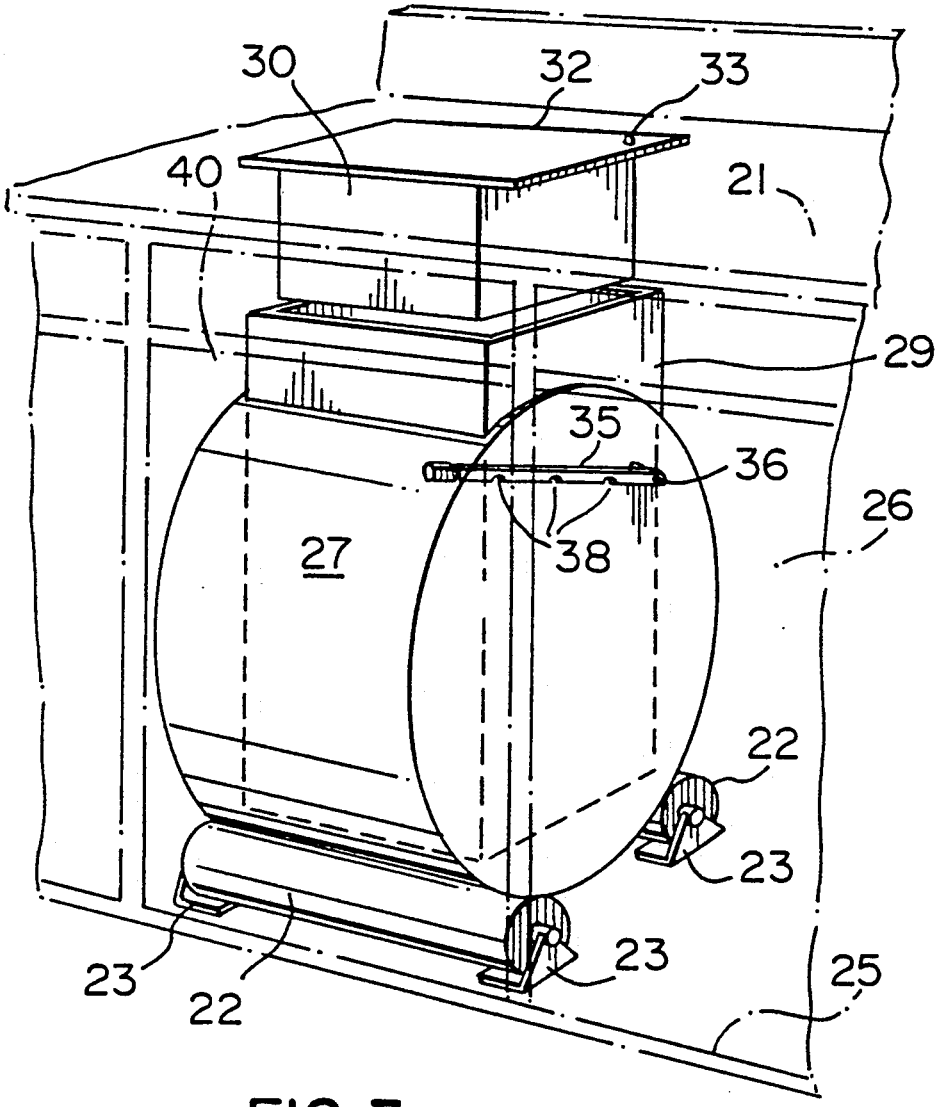
FIG. 3 is a perspective view of a second embodiment of the invention mounted in of a kitchen counter.
Figure 4:
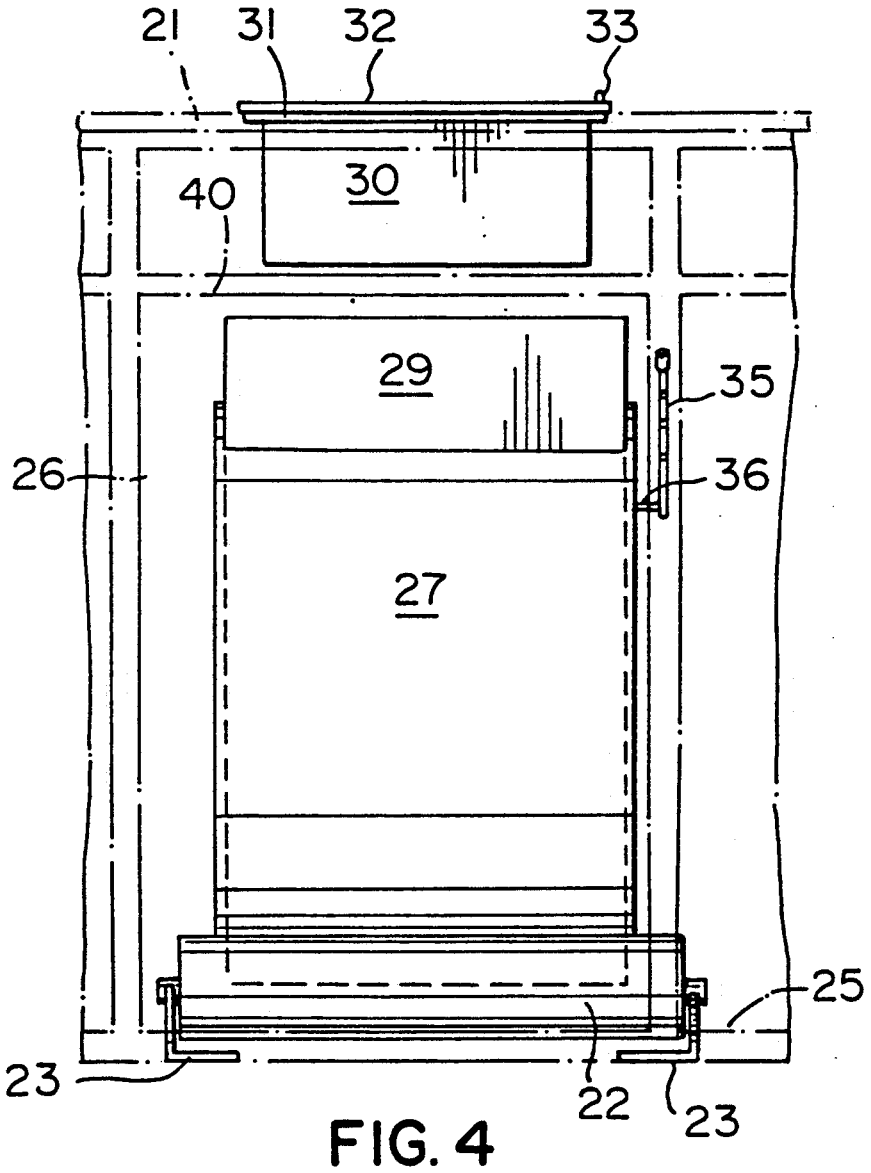
FIG. 4 is a front view of the container of FIG. 3.
Figure 5:
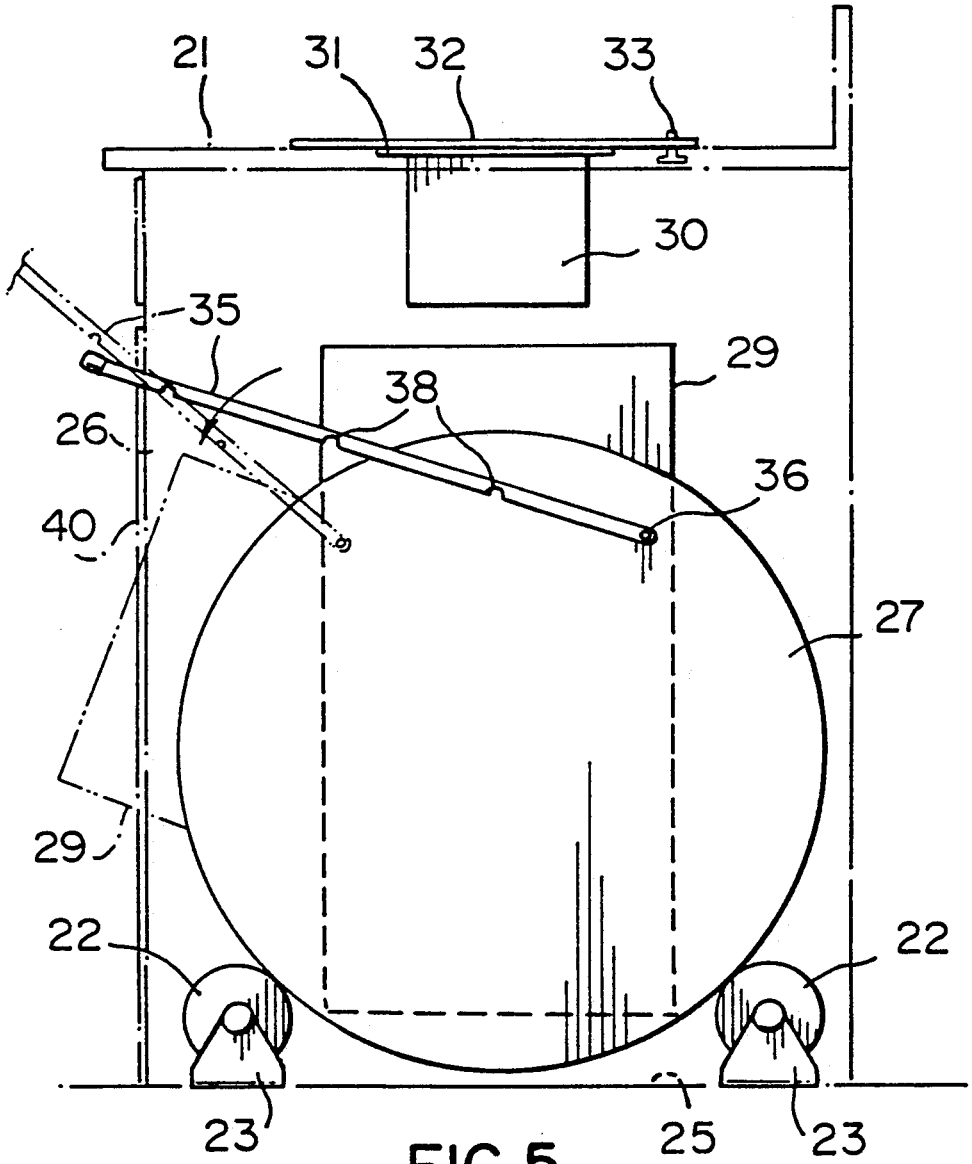
FIG. 5 is a side view of the container of FIG. 3.

Referring to FIGS. 3 to 5, a similar structure can be built into a housing defined by a kitchen counter 21. In this case, elongated cylindrical rollers 22 are rotatably mounted on corner brackets 23, and the brackets 23 are secured to the floor 25 of a cupboard 26 beneath the counter 21. The rollers 22 support a drum 27. A partition defined by a rectangular tube 29 is provided in the drum 27 for receiving a garbage bag (not shown). Garbage is introduced into the tube 29 via a square cross section, plastic sleeve or chute 30 mounted in an opening in the countertop 21. For such purpose a flange 21 is provided around the top end of the chute 30. The chute 30 is normally closed by a cover defined by a cutting board 32 pivotally connected to the countertop 21 by a pin 33. The drum 27 and the tube 29 are tilted from the loading position (FIGS. 3 and 4) to the unloading position shown in phantom outline in FIG. 5 by means of a rod 35, which is pivotally connected at one end to the drum 27 by a pin 36. The rod 35 extends outwardly through an opening (not shown) in the cupboard 26 for manual actuation. Notches 38 are provided in the bottom of the rod 35 for engaging the bottom of the opening to lock the drum 27 and the tube 29 in one position. In order to unload the tube 29, a door 40 on the cupboard 26 is open and the rod 25 is pulled to rotate the drum 27 and the tube 29 to the unloading position.

Figure 6:
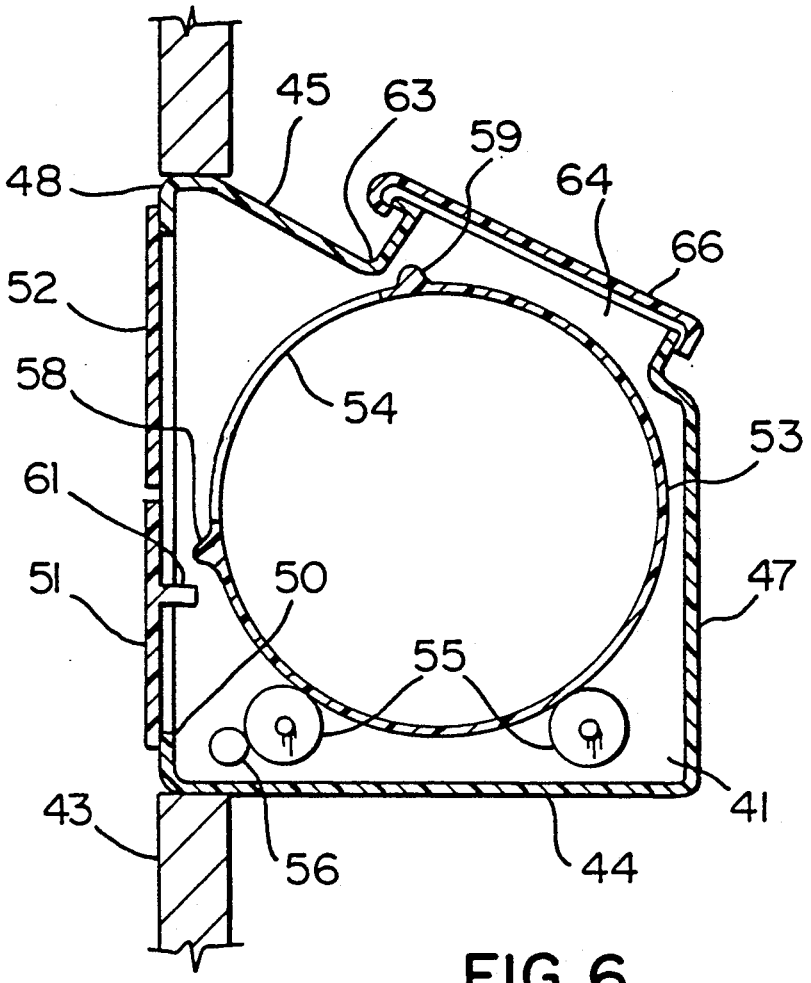
FIG. 6 is a schematic, longitudinal sectional view of another embodiment of the apparatus of the present invention.

Referring to FIG. 6, a third embodiment of the invention which is similar to the structure illustrated in FIGS. 1 and 2 includes a housing 41 for mounting in an exterior wall 43 of a dwelling. The housing 41 is an elongated, generally rectangular one-piece plastic molding and is defined by a bottom wall 44, a top wall 45, side walls (not shown), an inner or front end wall 47, and an outer or rear end wall 48, which is accessible from the exterior of the dwelling. An opening 50 in the exterior wall 48 is closed by a bottom panel 51 and doors 52.

A cylindrical drum 54 with closed ends is rotatably mounted on cylindrical rollers 55 in the housing 41. The rollers 55 are driven by a motor shown schematically at 56. Rotation of the drum 53 between the loading and unloading positions is limited by stops, which are defined by projections 58 and 59 on the drum 53. In the loading position the projection 58 engages a lug 61 on the panel 51, and the projection 59 engages a second lug defined by the bottom of a recess 63 in the top wall 45 of the housing 41. In the unloading position of the drum 53 (not shown) the projection 58 engages the bottom of the recess 63. Thus, movement of the drum 53 is limited to rotation between the loading and unloading positions. Material is removed from the drum 53 through an opening 64 in the top wall 45 of the casing 41. The opening 64 is normally closed by a cover 66.

Figure 7:
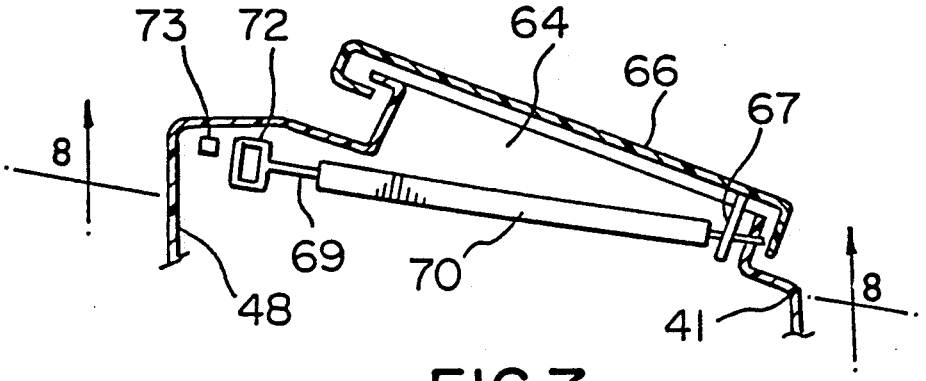
FIG. 7 is a cross sectional view of the top portion of a container similar to that shown in FIG. 6 illustrating a latch mechanism.
Figure 8:
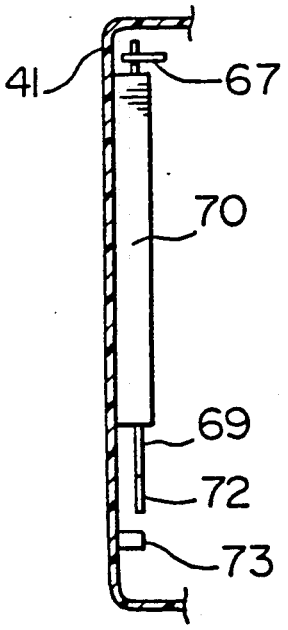
FIG. 8 is a cross section taken generally along line VIII—VIII FIG. 7 with parts omitted.

Referring to FIGS. 7 and 8 of the drawings, a suitable latch mechanism for use in a device of the type illustrated in FIG. 6 includes a lug 67 extending downwardly from one end of the cover 66 for receiving one end of a rod 69, which also extends through a hole in one side of the neck defining the opening 64. The rod 69 is slidably mounted in a sleeve 70 mounted on one end of the casing 41. A loop 72 is provided on the other end of the rod 69 for engaging a lug 73 extending outwardly from the end wall of the casing 41 to retain the cover in the unlatched condition.

It will be appreciated that the various features of the three embodiments of the invention specifically described hereinbefore can all be incorporated in a single device. For example, the tube 30 or a shorter version thereof can be incorporated in the device of FIGS. 1 and 2 or in the casing 41 of FIG. 6 when using the device as a garbage bin for inside loading and outside unloading. Moreover, latches or locks can be provided on one or all of the doors or covers used in the container. While not shown in the drawings, when the container is used in cold climates, the walls of the housing and the outside covers or doors are insulated.

WHAT I CLAIM IS:

1. A multi-port container comprising housing means; first and second openings in separate walls of said housing means permitting access to the interior thereof; drum means for receiving material in said container; a third opening in said drum means for loading said drum means or removing material therefrom; and roller means supporting said drum means for rotation in said housing means, whereby said drum means can be rotated to align said third opening with said first or second opening to permit loading and unloading of said drum means at different locations on said housing means.

2. A container according to claim 1, wherein said first opening is in a top wall of said housing means and said second opening is in a front wall of said housing means, whereby said drum means can be loaded via said top wall and unloaded via said front wall.

3. A container according to claim 2, including partition means in said drum means aligned with said third opening for defining a material receiving chamber.

4. A container according to claim 3 wherein said partition means includes tube means extending out of said third opening for retaining a garbage bag beneath said first opening when said first and third openings are aligned with each other.

5. A container according to claim 4, including handle means connected to said drum means for facilitating rotation thereof between loading and unloading position in which the third opening is aligned alternatively with said first and second openings.

6. A container according to claim 1, including drive means for rotating said roller means.

7. A container according to claim 1, including cover means on at least one of said first and second openings; and latch means for retaining said cover means in the closed position.

8. A container according to claim 1, including stop means for limiting rotation of said drum means between the loading and unloading positions.

9. A container according to claim 1, wherein said stop means includes projection means on said drum means and lug means on said housing means for engaging said projection means to limit rotation of said drum means.

* * * * *